US005970292A

United States Patent [19]

Miller

[11] Patent Number: 5,970,292

[45] Date of Patent: Oct. 19, 1999

[54] SECURING FEATURE FOR TONER CONTAINER SHUTTER

[75] Inventor: Daniel C. Miller, Fairport, N.Y.

[73] Assignee: Xerox Corporation, Stamford, Conn.

[21] Appl. No.: 09/172,351

[22] Filed: Oct. 14, 1998

[51] Int. Cl.[6] ..... G03G 15/08

[52] U.S. Cl. ..... 399/262; 141/346; 141/351; 222/DIG. 1

[58] Field of Search ..... 399/12, 224, 262; 141/346, 351, 363, 365; 222/DIG. 1, 162

[56] References Cited

U.S. PATENT DOCUMENTS

| | | | |
|---|---|---|---|
| 4,060,105 | 11/1977 | Feldeisen et al. | 141/363 |
| 4,650,070 | 3/1987 | Oka et al. | 399/119 |
| 5,089,854 | 2/1992 | Kaieda et al. | 399/262 |
| 5,091,750 | 2/1992 | Yoshida et al. | 399/106 |
| 5,150,807 | 9/1992 | Seyfried et al. | 399/106 |
| 5,331,382 | 7/1994 | Miura et al. | 399/263 |
| 5,383,502 | 1/1995 | Fisk et al. | 399/262 |
| 5,559,589 | 9/1996 | Eichberger et al. | 399/119 |
| 5,615,001 | 3/1997 | Kawashima et al. | 399/226 |
| 5,630,198 | 5/1997 | Makino | 399/120 |
| 5,655,179 | 8/1997 | Ueda et al. | 399/262 |
| 5,655,181 | 8/1997 | Chadani et al. | 399/114 |
| 5,678,121 | 10/1997 | Meetze, Jr. et al. | 399/12 |
| 5,710,963 | 1/1998 | Dirx | 399/262 |
| 5,734,953 | 3/1998 | Tatsumi | 399/262 |
| 5,774,773 | 6/1998 | Otsuka et al. | 399/262 |
| 5,812,915 | 9/1998 | Farkash | 399/262 |
| 5,848,338 | 12/1998 | Okada | 399/262 |

*Primary Examiner*—William Royer
*Assistant Examiner*—William A. Noe
*Attorney, Agent, or Firm*—John S. Wagley

[57] ABSTRACT

A container for storing a supply of particles for use in a developer unit of an electrophotographic printing machine is provided. The container is fittable to an adapter having an adaptor feature therewith. The adaptor is associated with the developer unit. The container includes a body defining a chamber for storing particles therein. The body defines an aperture in the periphery of the body. The container also includes a cover for use in covering the aperture and a securing feature. The securing feature is associated with the cover. The securing feature cooperates with the adapter feature on the adapter to radially secure the cover with respect to the adaptor.

9 Claims, 8 Drawing Sheets

SECURING FEATURE FOR TONER CONTAINER SHUTTER

The present invention relates to an electrophotographic printing machine. More specifically, the invention relates to a container for storing toner.

Cross reference is made to the following application filed concurrently herewith: U.S. application Ser. No. 09/172,350, entitled "Self Unlocking Feature for Toner Container Shutter", by Daniel C. Miller.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable marking particles typically in the form of a powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey developer material to the latent image at a controlled rate so that the developer material effectively adheres electrostatically to the charged areas on the latent image. A commonly used technique for development is the use of a two-component developer material, which comprises, in addition to the toner particles which are intended to adhere to the photoreceptor, a quantity of magnetic carrier granules or beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll."

Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll.

In an electrophotographic printer as the toner within the developer material is transferred to the photoreceptor and eventually to the copy paper, this used toner must be replaced. The electrophotographic printer thus includes a toner container or cartridge from which fresh toner is dispensed into the machine. When using two component developer, a portion of the carrier granules will eventually deteriorate. Additional new carrier granules may be added to the machine to replace the deteriorated granules. The toner container or cartridge may thus alternatively store a mixture including a small quantity of carrier granules in addition to the toner. To provide for a small compact toner cartridge and to provide for a toner cartridge in which the opening to the cartridge may be easily removed, the toner cartridge typically has a compact shape with a small opening from which the toner is dispensed.

Traditionally when all the toner within the container had been consumed, additional toner was supplied to the machine by pouring toner from a separate refilling bottle into the container. This method permitted many toner particles to become airborne during filling and enter the machine. The operator may even miss the opening of the container during filling and spill large quantities of toner inside the machine. Since the toner is inherently very susceptible to electrostatic charges, the toner sticks electrostatically to all the remote recesses of the machine making cleaning of the machine necessary, time consuming, and expensive.

Recently, machines have been supplied with replaceable toner containers or cartridges to avoid some of the problems associated with spilling toner during refilling. While missing the opening of the container during filling and spilling large quantities of toner is alleviated by replaceable toner containers, spillage can occur from the old container during removal and from the new container during installation.

Toner in the toner container or cartridge must be fed therefrom to the latent image to effectuate development. Typically, toner containers are located with their openings in the bottom of the container whereby they may be emptied by gravity. In attempts to make inexpensive and compact electrophotographic printers and to minimize space and related costs, however, the shape of the toner container may not be conducive to a bottom opening or to an unassisted emptying of the container. This is particularly true for wide format copiers and printers. When the opening is not in the bottom or the geometry of the container does not promote the free flow of all the contents, a mechanism must be provided for removing the toner. While the demand for toner remains fairly constant, these mechanisms expel large quantities of toner when the container is full and progressively smaller amounts as the container empties. Typically the toner containers are cylindrical and the toner is removed therefrom by rotating the container and/or a member within the container, such as a spiral wire.

Toner containers are typically filled with toner either single component toner or two component developer material including marking particles, or toner, as well as, a carrier in the form of a spherical granules. It is important that toner containers to be filled in production filling operations include a large opening for the rapid filling of the toner container. To permit rapid and complete filling of the toner container, typically the longitudinal or long axis of the toner container is vertically oriented when filling the containers. Often the containers have a cylindrical shape or a circular cross section. Typically thus the toner container includes a large circular hole through which toner is added. This hole must then be plugged during shipment and for later use of the container.

The toner containers may require rotation to advance the toner particles to a dispense opening. For example, the toner container may include an external molded spiral which urges the particles to one end of the container. The spherical grooves requires that the toner container be rotated. Also the toner container may include a slidable door or opening in the periphery of the container through which toner is dispensed. The slidable cover for the dispensing hole may require rotation of the toner container to open and close the dispensing hole. Features thus have been added to the toner container in the form of a handle to permit rotation of the toner container.

Slidable closures for toner container openings are required to be closed during shipment and storage and opened during container use within the machine. While slidable toner container closures are helpful in limiting toner spilling within a printing machine, the use of slidable toner container closures have certain problems.

For example, toner may spill from the toner container opening during installation of the toner container within the developer unit of the printing machine. Attempts have been made to provide for insertion of a toner container with a slidable closure into the development unit with the toner container closed and after insertion of the container to rotate the container thereby opening the slidable closure. Such a system has two problems in that the door may become partially opened during the installation process and the door may rotate into a closed position during machine operation thereby stopping the needed flow of toner into the container.

To provide for the opening and closing of the slidable closures while the container is positioned in the developer unit, developer units have been made which include pockets for receiving the container and a pocket portion for receiving the slidable closure. After insertion of the container with the slidable closure in the closed position, the toner container is rotated thereby opening the slidable closure while the container is in position in the developer unit. The slidable cover is typically slidably secured to the toner container by a pair of rails on the container which mates with a pair of rails on the slidable closure. The slidable shutter thereby rides along the rails to control the opening and closing of the shutter. To prevent toner leakage of the toner cartridge at the toner cartridge and adapter interface, the toner cartridge mates with the developer unit when rotated into position, sealing the cartridge against a foam seal in the developer unit.

This method of opening and closing the slidable closure with a closure pocket in the developer unit that mates with the closure has a particular problem in that the operator loading the toner cartridge can bias the toner cartridge away from the pocket in the developer unit, causing the closure of the toner cartridge to slip out of the closure pocket. By so mispositioning the cartridge away from the developer unit, a gap between the cartridge and the developer unit occurs, which allows toner to leak all over the inside of the machine. This problem is compounded even further due to the fact that the entire toner container holder of the developer unit rotates to allow the next color to be developed.

The following disclosures may be relevant to various aspects of the present invention:

- U.S. Pat. No. 5,734,953 Patentee: Tatsumi et al. Issue Date: Mar. 31, 1998
- U.S. Pat. No. 5,678,121 Patentee: Meetze, Jr. et al. Issue Date: Oct. 14, 1997
- U.S. Pat. No. 5,655,181 Patentee: Chadani et al. Issue Date: Aug. 5, 1997
- U.S. Pat. No. 5,630,198 Patentee: Makino Issue Date: May 13, 1997
- U.S. Pat. No. 5,615,001 Patentee: Kawashima et al. Issue Date: Mar. 25, 1997
- U.S. Pat. No. 5,559,589 Patentee: Eichberger et al. Issue Date: Sep. 24, 1996
- U.S. Pat. No. 5,383,502 Patentee: Fisk, et al. Issue Date: Jan. 24, 1995
- U.S. Pat. No. 5,331,382 Patentee: Miura et al. Issue Date: Jul. 19, 1994
- U.S. Pat. No. 5,150,807 Patentee: Seyfried, et al. Issue Date: Sep. 29, 1992
- U.S. Pat. No. 5,089,854 Patentee: Kaieda et al. Issue Date: Feb. 18, 1992
- U.S. Pat. No. 4,650,070 Patentee: Oka, et al. Issue Date: Mar. 17, 1987
- U.S. Pat. No. 5,812,915 Patentee: Farkash Issue Date: Sep. 22, 1998

The relevant portions of the foregoing disclosures may be briefly summarized as follows:

U.S. Pat. No. 5,734,953 discloses an image forming apparatus having independently detachable toner supply units and image processing units. The toner supply unit includes a toner supply port, a first shutter controlling a toner flow path of the toner supply port, and a first guide rib formed on the toner supply unit. The image processing unit includes a toner acceptance port, a second shutter controlling the toner flow path of the toner acceptance port, and a second guide rib formed on the image processing unit. The first and second guide ribs engage the second and first shutters when the toner supply unit and the image processing unit are both attached to the main body of the image forming apparatus. If either the toner supply unit or the image processing unit is removed from the main body, the guide ribs disengage the corresponding shutters, causing the shutters to close the toner flow paths. Reassembling the toner supply unit with the image processing unit engages the shutters to reopen the toner flow paths.

U.S. Pat. No. 5,678,121 discloses in a hard copy document production machine using a plurality of different type cartridges containing different document production consumable materials, an orientation-independent cartridge type discriminating system assembly suitable for enabling non-burdensome orientation-independent loading of a correct cartridge into a cartridge opening in the machine, and for resiliently intercepting and preventing loading of an incorrect cartridge into the cartridge opening. The discriminating system assembly includes a resilient assembly mounted to a portion of the frame of the machine defining the cartridge opening, a first spring member, and a pivotable elongate member connected to the spring member for providing resilient cartridge contact with a cartridge being inserted. The elongate member has a displaceable portion, and a cartridge blocking portion spaced from the displaceable portion in a direction of cartridge insertion. The displaceable portion has a cartridge-type first specific distance measured from the cartridge blocking portion, and the cartridge blocking portion has a first position within the cartridge opening, and a second position adjacent the cartridge opening. The discriminating system assembly also includes a displacer device formed on a surface of a cartridge being inserted into the cartridge opening, and has a cartridge-type specific second distance measured from a lead edge of a cartridge of the type of cartridge being inserted. The cartridge-type specific second distance determines a correct cartridge when it is equal to the cartridge-type specific first distance, and the displacer device extends continuously and uniformly in a direction transverse to the direction of cartridge insertion, so as to enable non-burdensome, orientation-independent loading of a cartridge into the cartridge opening.

U.S. Pat. No. 5,655,181 discloses a toner accommodation container for containing toner to be used for developing a latent image formed on a electrophotographic photosensitive member, wherein the toner accommodation container is supplied with toner from a toner supply container which includes a toner accommodating portion for accommodating the toner; a toner supply opening for supplying toner; a cover member for covering the toner supply opening, wherein the cover member is movable between a closing position for covering the toner supply opening and an open position for permitting supply of the toner therethrough; a blocking member, provided inside the covering member, for preventing the toner from scattering from the toner accommodating portion to outside, the blocking member is locked by a first locking member and a second locking member; wherein the blocking member is movable to the open position by the first locking member being released by the toner supply container and the second locking member being released by the cover member.

U.S. Pat. No. 5,630,198 discloses a toner fillable cartridge for use with a toner developing device includes a toner body having first and second ends, a toner exhaust port between the first and second ends, a toner box shielding member rotatably mounted on the toner body to open and close the toner exhaust port as the toner body is rotated with respect to the development device and the toner box shielding member, and a pair of protrusions formed on each side of the toner box shielding member. Each of the pair of protrusions are structured to engage a developing device shielding member movably positioned over a toner introduction port of the developing device. Rotation of the toner body with respect to the development device causes each of the pair of protrusions to engage and displace the developing device shielding member to open and close the toner introduction port as the toner exhaust port rotates to align with the toner introduction port.

U.S. Pat. No. 5,615,001 discloses a plurality of electrostatic recording units being arranged in series along a path for moving a recording sheet of paper, and charged toner images having different colors are formed on the sheet of paper traveled through the path. A paper feeder unit is arranged beneath a paper introduction side of the paper moving path. The sheet of paper carrying the toner image formed thereon is ejected from a paper ejection side of the paper moving path, and is sent to a fixer in which the toner image is fixed on the sheet of paper. The sheet of paper carrying the toner image fixed thereon is sent to a paper receiver tray positioned above the fixer.

U.S. Pat. No. 5,559,589 discloses an improved keying system for categorizing a consumable cartridge by using a two component system including a relatively long-lived portion and the relatively short-lived consumable cartridge. The improved system includes a lug element and a structure for mounting the lug element to the relatively long-lived portion, which may be the inner housing of a copier machine or other machine using consumable cartridges. Ideally, the lug element is self-fixturing into a void space. The consumable cartridge has portions defining a void into which the lug element projects when the consumable cartridge is inserted into the relatively long-lived portion for machine operations.

U.S. Pat. No. 5,383,502 discloses an imaging material replenishment system for a reproduction apparatus, with an imaging material container removably insertable into an insertion guide, which container has a containment lid automatically removed upon insertion, with a lid latching member with a latching notch normally latching the containment lid to the container. The insertion guide has a latch engaging member such as a fixed pin positioned to engage an unlatching ramp surface of the lid latching member as the container is inserted, a locking slot returning the pin therein during dispensing, and thus holding the lid there, and another, oppositely inclined, ramp surface automatically relatching the lid to the container as the container is removed after dispensing. An integrated contents encoding and interlock system is also provided.

U.S. Pat. No. 5,331,382 discloses a toner cartridge for an image forming apparatus including a case body having a tubular portion, first and second end walls, and first and second positioning members. The first positioning member radially protrudes from the first end wall and has a flat end face. The first positioning member, which is used for positioning the toner cartridge at the start of loading the toner cartridge into the image forming apparatus, is aligned with a first guide in the image forming apparatus at the start of loading the toner cartridge. The second positioning member, which radially protrudes from the second end wall of the cartridge and has a flat end face, is angularly shifted from the first positioning member. After the first positioning member is aligned with the guide, the cartridge is rotated to align the second positioning member with a second guide in said image forming apparatus.

U.S. Pat. No. 5,150,807 discloses an apparatus for storing marking particles is described which includes a container defining a chamber for storing the marking particles therein and having an opening defined therein for the discharge of the marking particles therefrom. The apparatus further includes a seal member secured to the container, the seal member having an opening defined therein which is at least partially coextensive with the opening of the container for the passage of marking particles therethrough. Moreover, the apparatus includes a cover positionable over the opening defined in the seal member, the cover being removably secured to the seal member with an adhesive material.

U.S. Pat. No. 5,089,854 discloses an apparatus for supplementing a toner into a toner hopper of a developing device using the toner including a toner supplementing container having a toner bottle having an opening, a shutter member movable between a close position in which the opening of the toner bottle is closed by the shutter member and an open position in which the opening of the toner bottle is not closed by the shutter member, and a shutter locking member for locking the shutter member into the close position; and a container fixing and locking mechanism arranged on the toner hopper and having a fixing member for fixing the toner supplementing container onto the toner hopper and a locking member which is movable into a locked position in which the shutter locking member is released to allow the movement of the shutter member into the open position and the toner supplementing container could not be removed from the toner hopper and an unlocked position in which the toner supplementing container can be removed from the toner hopper and the shutter member is locked in the close position. When the shutter member is moved into the open position, the user could not handle the container locking member, because the container locking member is hidden by the shutter member. In this manner, the toner can be positively and easily supplemented into the developing device by means of the toner hopper without causing undesired spread of the toner.

U.S. Pat. No. 4,650,070 discloses a toner cartridge for use in replenishing additional toner to a toner storing section of an imaging machine, such as an electrophotographic copier, which uses toner to produce a visible image is provided. The present toner cartridge includes a trough-shaped container having an opening, a cover which is large enough to encompass the opening and supported to be slidably movable with respect to the container between a closed position to close the opening and an open position to open the opening, and a seal member having one end fixed to the container and another end fixed to the cover. Thus, when the cover is moved from the closed position to the open position, the seal member is partly separated away from the container to make the opening half-open. Then, the seal member is pulled to completely open the opening to have the toner completely discharged from the container. Thereafter, the cover is returned to the closed position to close the opening. With such a structure, toner is completely prevented from being scattered.

U.S. Pat. No. 5,812,915 discloses a plug for use in plugging an aperture in a container for storing a supply of particles for use in a developer unit of an electrophotographic printing machine is provided. The plug includes a base, a rim extending from the periphery of the base. The rim may cooperate with the aperture. The plug further includes a stem extending from the base and spaced from the rim, so that the rim may conform to the aperture and thereby seal the aperture without being affected by the handle.

SUMMARY OF THE INVENTION

According to the present invention, there is provided a container for storing a supply of particles for use in a developer unit of an electrophotographic printing machine. The container is fittable to an adapter having an adapter feature therewith. The adapter is associated with the developer unit. The container includes a body defining a chamber for storing particles therein. The body defines an aperture in the periphery of the body. The container also includes a cover for use in covering the aperture and a securing feature. The securing feature is associated with the cover. The securing feature cooperates with the adapter feature on the adapter to radially secure the cover with respect to the adapter.

According to the present invention, there is also provided a developer unit for developing a latent image recorded on an image receiving member of an electrophotographic printing machine. The developer unit includes an adapter including an adapter feature associated therewith. The developer unit also includes a container for storing a supply of particles. The container includes a body defining a chamber for storing particles therein. The body defines an aperture in the periphery thereof. The container also includes a cover. The cover is for use in covering the aperture. The cover includes a securing feature associated with the cover. The securing feature cooperates with the adapter feature on the adapter for radially securing the cover with respect to the adapter.

According to the present invention, there is further provided an electrophotographic printing machine for developing a latent image recorded on an image receiving member with a supply of particles. The printing machine includes a developer unit including an adapter. The adapter includes an adapter feature. The printing machine further includes a container for storing a supply of particles. The container is fitted at least partially into the adapter. The container includes a body defining a chamber for storing particles therein. The body defines an aperture in the periphery thereof. The container further includes a cover for use in covering the first aperture and a securing feature. The securing feature is associated with the cover. The securing feature cooperates with the adapter feature on the adapter for radially securing the cover with respect to the adapter.

IN THE DRAWINGS

Figure 1:
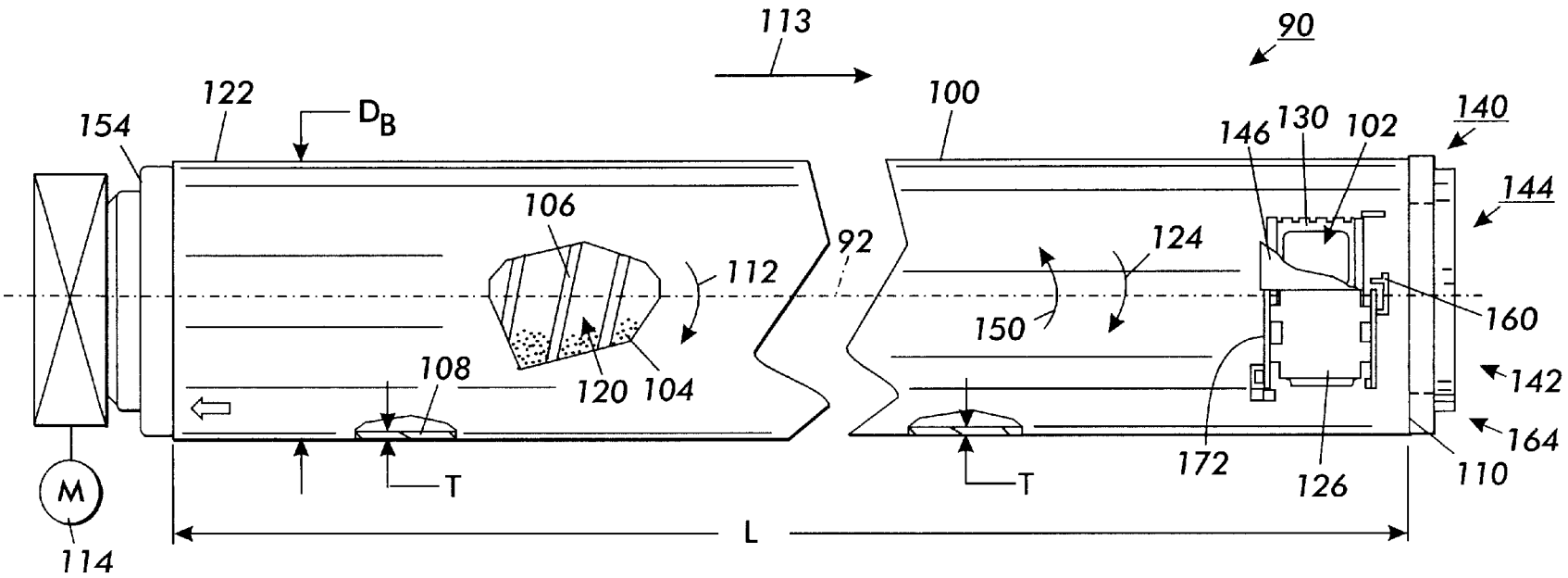
FIG. 1 is a plan view of a toner container utilizing an embodiment of the toner container securing feature with the door in the opened position according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 4 printing machine will be shown hereinafter schematically and their operation described briefly with reference thereto.

For a general understanding of the features of the present invention, reference is made to the drawings. In the drawings, like reference numerals have been used throughout to designate identical elements. It will be evident from the following discussion that the present invention is equally well suited for use in a wide variety of printing systems, and is not necessarily limited in its application to the particular system shown.

Figure 4:
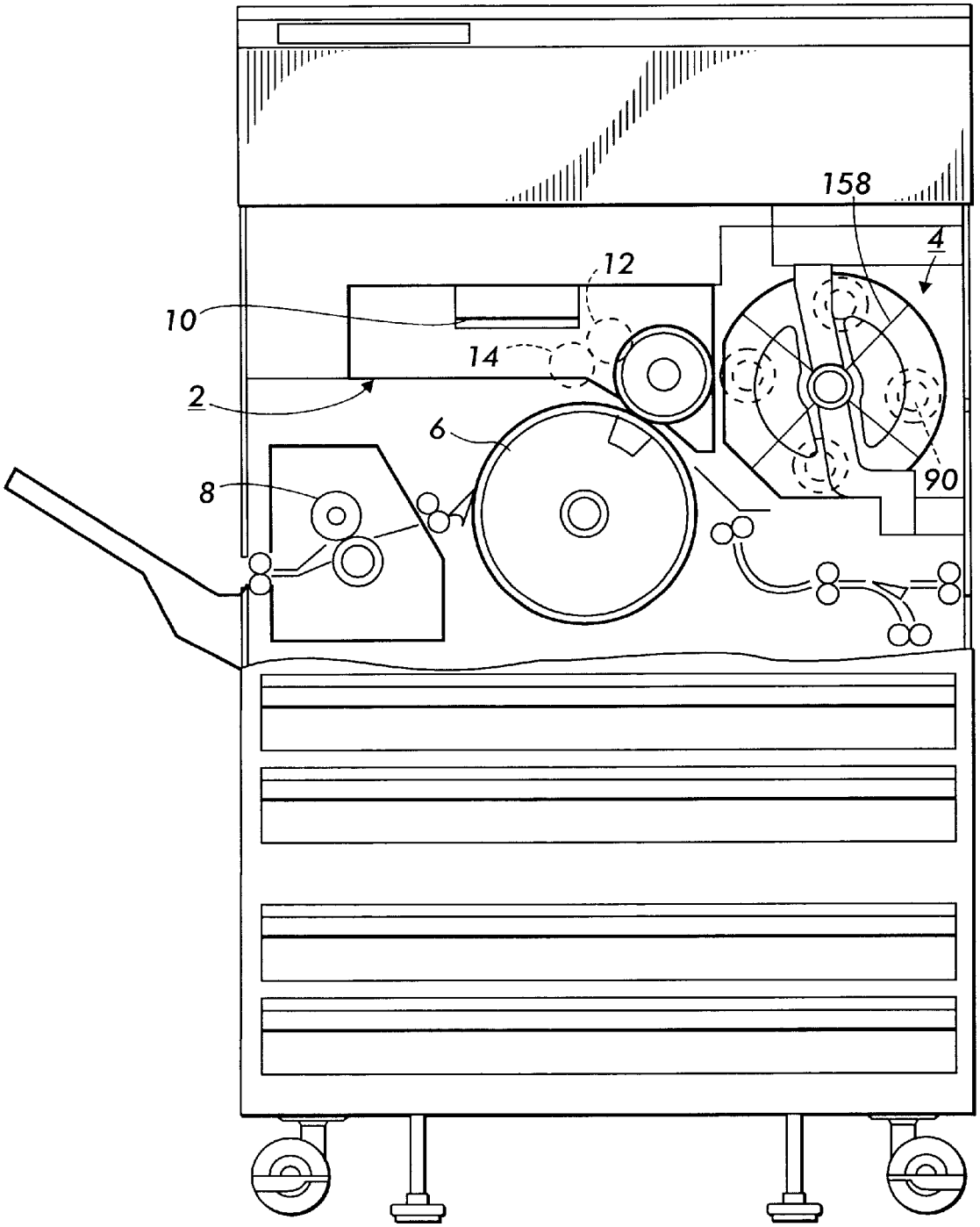
FIG. 4 is a plan view of an illustrative electrophotographic printing machine incorporating the toner container with the door securing feature door of FIG. 1.
Figure 5:
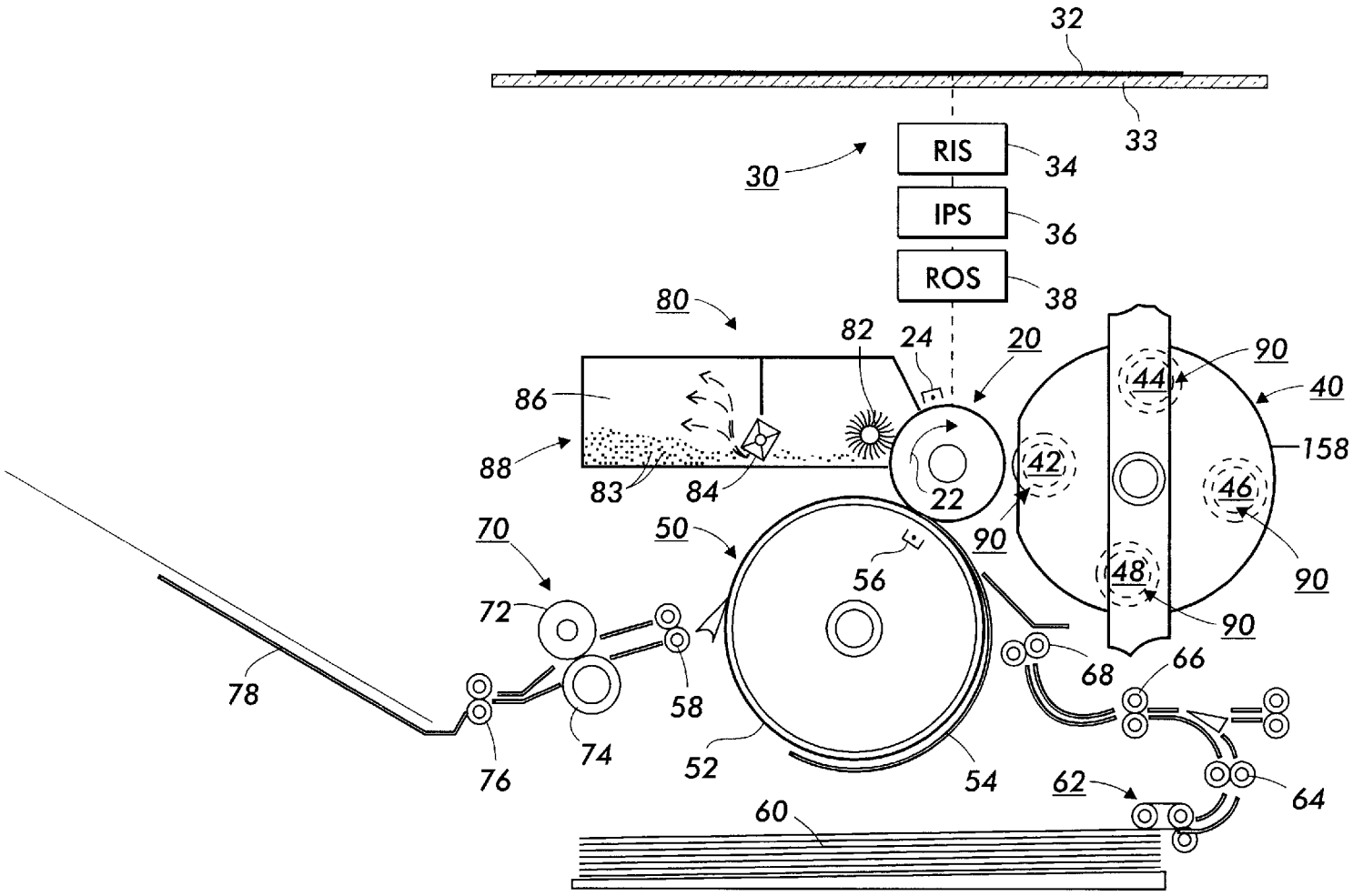
FIG. 5 is a schematic elevational view of the illustrative electrophotographic printing machine of FIG. 4.

Referring to FIGS. 4 and 5 of the drawings there is shown by way of example an automatic xerographic reproduction or printing machine, incorporating the door securing feature of the present invention.

FIG. 4 shows the interior of a xerographic printing machine with a xerographic module 2, a developer unit 4, a transfer unit 6 and a fusing unit 8. Xerographic module 2 has handle 10, cleaner brush external gear 12 and toner moving member external gear 14.

Referring now to FIG. 5, there is shown a schematic view of an electrostatographic or xerographic printing or copying machine employing a photoconductor 20. Photoconductor 20 moves in the direction of arrow 22 to advance successive portions of the surface sequentially through the various processing stations disposed about the path of movement thereof.

Initially, a portion of photoconductor 20 passes through the charging station. At the charging station corona generating device 24 charges photoconductor 20 to a relatively high, substantially uniform potential.

Next, the charged photoconductor is rotated to the imaging station 30. At the imaging station, original document 32 is positioned on a transparent platen 33. Imaging station 30 also includes a raster scanning system which includes a raster input scanner (RIS) 34, an image processing system (IPS) 36 and a raster output scanner (ROS) 38. The RIS scans the original document one line at a time generating signals with each signal being representative of at least one color component in original document 1n 32. The RIS captures the entire image from the original document 32 and converts it to a series of raster scan lines which are transmitted as electrical signals to IPS 36. The electrical signal from the RIS correspond to red, green and blue intensities at each point in the document. The IPS takes the red, green and blue signals and connects them to the proper cyan, magenta and yellow signals transmitted to ROS 38. The ROS illuminates the charged portion of the photoconductive surface to record four electrostatic latent images on the photoreceptor.

After the electrostatic latent image has been recorded on photoconductor 20, the photoreceptor advances the electrostatic image to the development station 40. The development station includes four individual developer units generally indicated by the reference numerals 42, 44, 46 and 48. The developer units may be any kind of development unit. Developer units 42, 44, 46 and 48 respectively apply toner particles of magenta, yellow, cyan and black color. Each of the developer units is moved into and out of the operative position. In the operative position, the desired developer unit is moved adjacent to the photoreceptor. In FIG. 5, developer unit 42 is shown in the operative position with developer units 44, 46 and 48 being in the non-operative position. Each of the developer units include a toner containing device 90 for containing a supply of the appropriate primary color or black toner.

After development, the toner image is moved to the transfer station 50 where the toner image is transferred to a sheet of support material 54. At the transfer station, the transfer roll 52, moves a sheet into contact with photoreceptor 20. Transfer roll 52 electrostatically tacks the sheet of support material to its surface where the sheet may be retained for multiple transfers.

The sheet is advanced from a stack of sheets 60 disposed on a tray. A feeder roll mechanism 62 advances the sheet to vertical sheet transport rollers 64. The sheet continues along the paper path to preregistration rollers 66 and registration rollers 68. These roller assemblies continue driving the sheet from the vertical transport, de-skew the sheet and release the sheet to the transport roll for image transfer.

At the transfer zone, a corona generating device 56 puts a charge on the inside surface of the transfer roller so that the toner particles are attracted to the support material on the transfer roll. The sheet remains secured to the transfer roll 52 so as to move in a recirculating path for as many passes as colors developed. In this way, the cyan, yellow, magenta and black toner images are transferred to the sheet in superimposed registration with one another to form a multi-color copy of the colored original document.

After the last transfer operation, the sheet is released from transfer roll 52. Transport rollers 58 transport the sheet to the fusing station 70 where the transferred image is permanently fused to the sheet. The fusing station includes a heated fuser roll 72 and a pressure roll 74. The sheet passes through the nip defined by fuser roll 72 and pressure roll 74. The toner image contacts fuser roll 72 so as to be affixed to the sheet. Thereafter, the sheet is advanced by forwarding rollers 76 to catch tray 78.

The last processing station in the direction of movement of photoreceptor 20, as indicated by arrow 22, is the cleaning station 80. The cleaning process takes place after each color is developed. A rotatably mounted fibrous cleaning brush 82 is positioned in the cleaning station and maintained in contact with photoreceptor 20 to remove residual toner particles 83 remaining after the transfer operation. Toner moving member 84 rotates to move toner collected by the fibrous brush into toner waste sump 86. The exit port 88 is located at the end board backside of the xerographic module.

It is believed that the foregoing description is sufficient for purposes of the present application to illustrate the general operation of an electrophotographic printing machine incorporating the door securing feature of the present invention therein.

Referring again to FIG. 4, the particle storage device or container 90 is shown. The particle storage device 90 is located within one of the developer units 42, 44, 46 or 48 of the development station 40 and is secured to the respective developer unit. The particle storage device 90 is positioned relative to the horizontal such that longitudinal axis 92 of the device 40 is located horizontally. The horizontal orientation of the storage device 40 is particularly well suited for copying large documents.

Referring now to FIG. 1, the container 90 includes a body 100 defining an aperture 102 in the form of an opening through which developer material 104 including at least marking particles is dispensed.

The body 100 may have any suitable shape and configuration capable of containing the developer material 104. For example, the body 100 may have a generally cylindrical shape and contain within the hollow body 100 a spirally shaped spring or auger 106 for urging the developer material 104 within the body 100 toward the developer units 42, 44, 46 and 48 (see FIG. 5).

Referring again to FIG. 1, the body 100 may be supported by supports (not shown) in the form of a V or similarly shaped cradle. The body 100 may thus be replaced by lifting the body 100 in a vertical direction away from the cradle. Preferably, however, the body 100 is supported by an adapter 158 in a pocket in the developer unit 40 (see FIG. 4).

Referring again to FIG. 1, the spirally shaped spring or auger 106 is located within the periphery 108 of the body 100 to urge the material 104 toward dispensing end 110 of the body 100. The spirally shaped spring or auger 106 is rotated in the direction of arrow 112 whereby the spirally shaped spring or auger 106 conveys the material 104 in the direction of arrow 113. The spirally shaped spring or auger 106 is rotated by any suitable device for example a drive motor 114 or by a common motor (not shown) connected to the spirally shaped spring or auger 106 by a drive train (not shown). The drive motor 114 may be connected to the spirally shaped spring or auger 106 by any suitable method.

The body 100 may have any suitable size necessary to store a sufficient quantity of developer material 104 within chamber 120 of the body 100. For example, the body 100 may have a length L of approximately 13 inches and a diameter $D_B$ across the external periphery 122 of the body 100 of approximately 2 ¾ inches.

The body 100 may be made of any suitable durable material and may, for example, be made of acetyl or polyethylene. The body 100 may likewise be made of a glass filled polycarbonate for increased strength. When made of acetyl or polyethylene, the body 100 may have a thickness T sufficient to maintain the strength of the body 100, for example, the thickness T may be approximately 0.020 to 0.050 inches.

The body 100 may be made by any suitable method, for example, the body 100 may be injection molded by any suitable injection molding process.

To permit the material 104 to exit the body 100, the body 100 includes the dispensing opening 102 from which the material 104 is dispensed from the body 100. The opening 102 may have any suitable shape, for example, include a round aperture or square or rectangular aperture. The cross sectional area of the opening 102 is selected to provide for the proper amount of material 104 to be distributed from the container depending on the need of the copy machine (not shown). The opening 102 is preferably located on periphery 122 of the dispensing end 110 of the body 100. The body 100 may be integrally molded or may be fabricated from a paper tube.

With each rotation of the body 100, in the direction of arrow 124, the opening 102 moves from an opening upward toward an opening downward position and back to an opening upward position. With each rotation of the body 100, the opening thus cycles about the periphery 122 of the body 100 permitting a defined amount of material 104 to be dispensed from the body 100.

To provide for covering the opening 102 during shipment, storage and installation, the body 100 includes a closure or cover 126 in the form of for example a sliding door. The door 126 matingly fits with outer periphery 122 of the dispensing end 110 of the body 100. The closure or cover 126 thus includes an inner periphery which mates with the outer periphery 122 of the dispensing end 110 of the body 100. The inner periphery is defined by a diameter which is slightly larger than diameter $D_B$ defining the outer periphery 122 of the dispensing end 110 of the body 100. A door seal 130 made of a suitable durable resilient material, for example a resilient foam, for example polypropylene, may be located around the opening 102 to ensure an adequate seal of the door 126 during shipment.

While it may preferable to not have a temporary seal, the container 90 may include a temporary seal (not shown) for sealing the material 104 within the body 100 during shipment. The body 100 may have the opening 102 at the dispensing end 110 covered by a removable cover seal (not shown) adhesively applied to the body 100. The cover seal may be made of any suitable material that is preferably gas permeable. For example, TYVEC®, a product of E.I. duPont de Nemours and Company, is suitable for this purpose.

Referring again to FIG. 1, the container 90 may include a plug 140. The plug 140 is utilized to seal fill opening 142 located in dispensing end 110 of the body 100. The plug 140 preferably includes a handle 144 which is utilized to rotate the body 100 in the direction of rotation 150. The door 126 contacts stop 146 of the developer unit such that by rotating the body 100 in the direction of arrow 150, the door 126 is moved from a position over the dispense opening 102 to its opened position as shown in FIG. 1.

Figure 2:
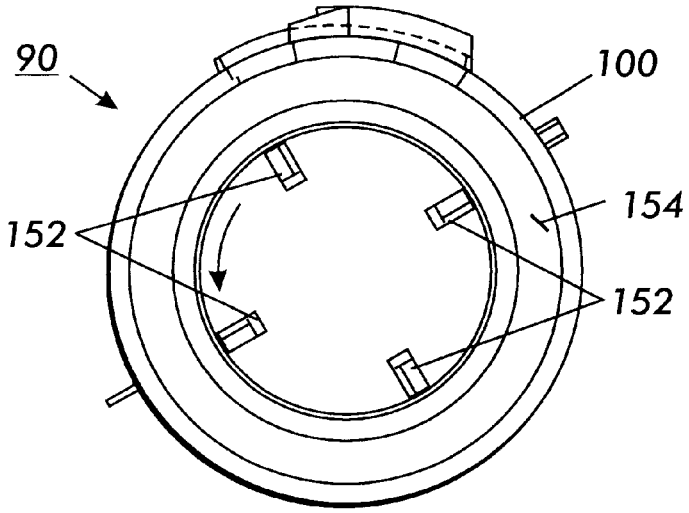
FIG. 2 is a first end view of the FIG. 1 toner container showing the drive tabs utilized for rotating the container auger.

Referring now to FIG. 2 the body 100 is shown with drive tabs 152 pointing outwardly from drive end 154 of the body 100. The drive tabs 152 serve to cooperate with drive adapter 116 of FIG. 1 in order that the auger 106 be rotated.

Figure 3:
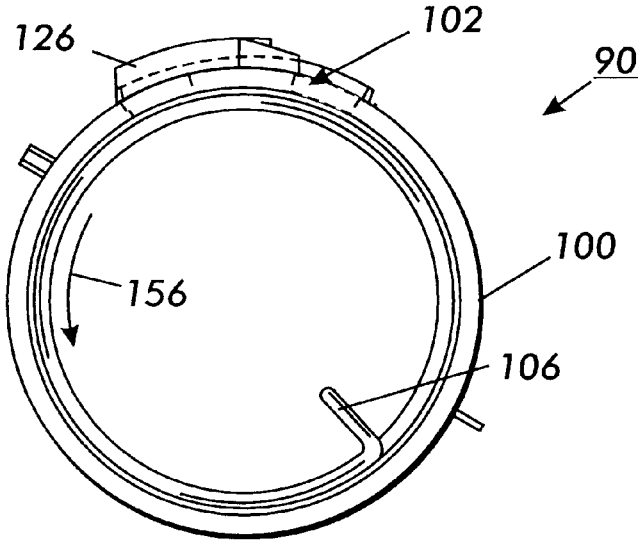
FIG. 3 is a second end view of the FIG. 1 toner container with the fill plug removed showing the container auger.

Referring now to FIG. 3 the container 90 is shown with the plug 140 removed from the body 100. The drive tabs 152 of FIG. 2 are utilized to rotate the wire auger 106 in the direction of arrow 156 such that the toner is advanced in the direction of arrow 113 (see FIG. 1).

Referring again to FIG. 1, the container 90 is utilized for storing a supply of particles 104 typically in the form of developer material for use in the developer unit 40 (see FIG. 5). The container 90 includes the cylindrical body 100 which defines chamber 120 therein. The body 100 includes the aperture 102 in the external periphery 122 of the body 100. The container 90 also includes the closure or cover 126 for use in covering the aperture 102. The container 90 further includes a latching member 160 for securing the cover 126 to the body 100.

Figure 9:
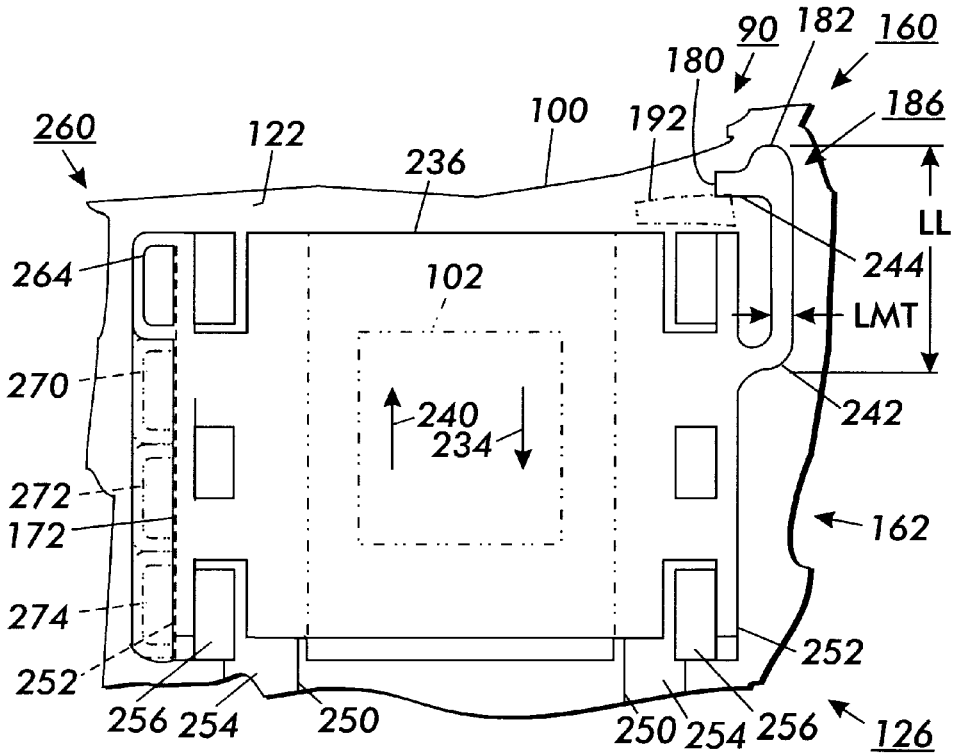
FIG. 9 is an enlarged plan view of the door of the container of FIG. 1 showing the color keyed stops for cooperation with the color keyed posts of the adapter of FIG. 6.

Referring now to FIG. 9, the latching member 160 has a latched position 162, wherein the cover 126 is fixedly position with respect to the body 100.

Referring again to FIG. 1, the latching member 160 also has an unlatched position 164 wherein the cover 126 is movable with respect to the body 100.

Figure 6:
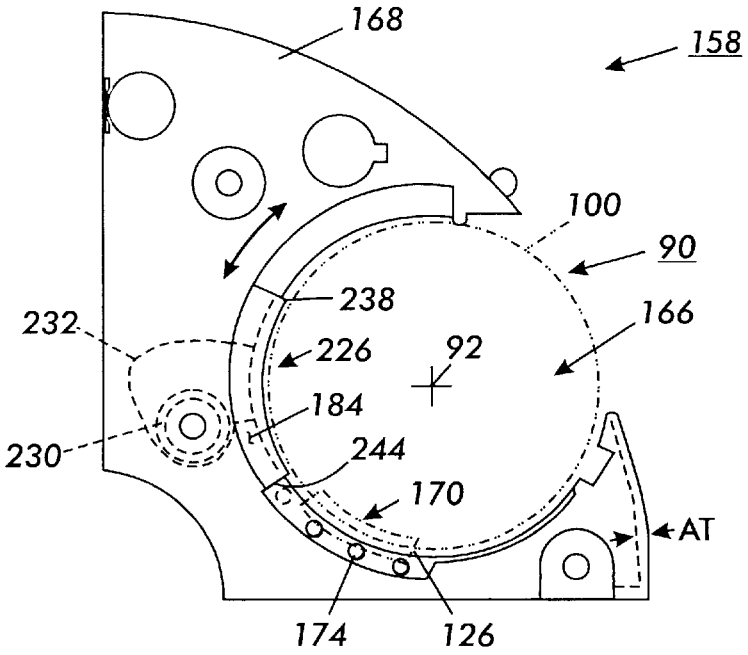
FIG. 6 is an end view of an adapter including color keyed posts for use with the FIG. 1 toner container.

Referring now to FIG. 6, the adapter 158 is shown in greater detail. According to the present invention, the adapter 158 cooperates with the latching member 160 such that, when the container 90 is inserted into the adapter 158, latching member 160 is moved from the latched position 162 to the unlatched position 164 (see FIGS. 1 and 9).

Referring again to FIG. 6, the adapter 158 may be made of any suitable, durable material and have any shape or configuration capable of receiving the container 90. For example, the adapter 158 may be made of a durable plastic, for example acetyl or polyethylene. The adapter 158 may likewise be made of a glass-filled polycarbonate for increased strength.

When made of acetyl or polyethylene, the adapter 158 may have a thickness AT of, for example, approximately 0.020 inches to 0.08 inches. The adapter 158 is preferably secured to the development station 40 (see FIG. 5).

While the invention may be practiced with a solitary adapter 158 for use with a color machine as shown in FIG. 4, preferably, the printing machine includes a plurality of adapters 158 with each adapter 158 being able to accommodate a container having one of the three primary colors, cyan, yellow, or magenta, or black. In which case each of the adapters 158 are associated with one of the adapter units 42, 44, 46 or 48 (see FIG. 5).

While the adapter 158 may be made of an assembly of various components, preferably, as shown in FIG. 6 for simplicity, the adapter 158 is molded as a unitary item. The adapter 158 preferably contains an adapter container pocket 166 to which the body 100 of the container 90 is slidably fitted along axis 92 of the container 90. The container 90, (see FIG. 1), may be loaded into the adapter 158 by installing drive end 154 of the container 90 into first end 168 of the adapter 158.

Preferably, as shown in FIG. 6, the adapter 158 includes an adapter cover pocket 170 which provides clearance for the cover 126 of the container 90 as it is loaded into the adapter 158. The container 90 thus is aligned with the cover 126 positioned in alignment with the adapter cover pocket 170.

Preferably, as shown in FIG. 6, the adapter 158 includes an adapter seal 238 positioned about adapter opening 226. The adapter seal 238 may be made of any suitable material and may, for example, be made of a material similar to that of door seal 130 (see FIG. 1).

To install the container 90 into the adapter 158, the container is positioned in the adapter 158 with the cover 126 in the closed and latched position 162 (see FIG. 9). The container 90 is installed with drive end 154 (see FIG. 1) loaded first into the adapter container pocket 166 with the cover 126 in alignment with the adapter cover pocket 170. The container 90 continues to be installed along axis 92 of the adapter 158 until seating face 172 (see FIG. 9) of the cover 126 contacts pocket seating face 174 of the cover pocket 170 of the adapter 158.

Figure 8:
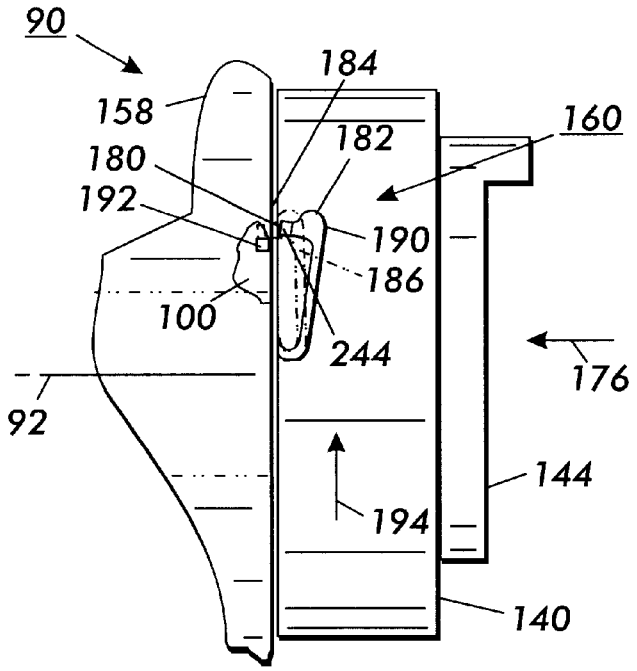
FIG. 8 is side view of FIG. 7 showing the latching member in the strained unlatched position.

Referring now to FIG. 8, the container 90 is shown with the container 90 positioned at full depth along axis 92 of the container 90. At the position as shown in FIG. 8, the pocket seating face 174 of the cover pocket 170 of the adapter 158 is fully seated against seating face 172 of the cover 126 (see FIGS. 1 and 6).

Referring again to FIG. 8, as the cover 90 is installed against the adapter 158 by inserting the container 90 in the direction of arrow 176, contact face 180 of free end 182 of the latching member 160 contacts surface 184 of the adapter 158. As the container 90 is further urged in the direction of arrow 176, the surface 184 pushes contact face 180 in a direction opposed to the direction of arrow 176 causing the latching member 160 to move from relaxed position 186 to restrained position 190.

When moved from relaxed position 186 to restrained position 190, free end 182 of the latching member 160 moves from a position in contact with body locking feature 192 of the body 100 to a position in which the free end 182 is spaced from the body locking feature 192. When the container 90 is fully installed into the direction of arrow 176, the latching member 160 is in the restrained position 190. In position 190 the free end 182 of the latching member 160 is no longer in contact with the body locking feature 192. In position 190, body 100 of the container 90 may be rotated in the direction of arrow 194.

Figure 7:
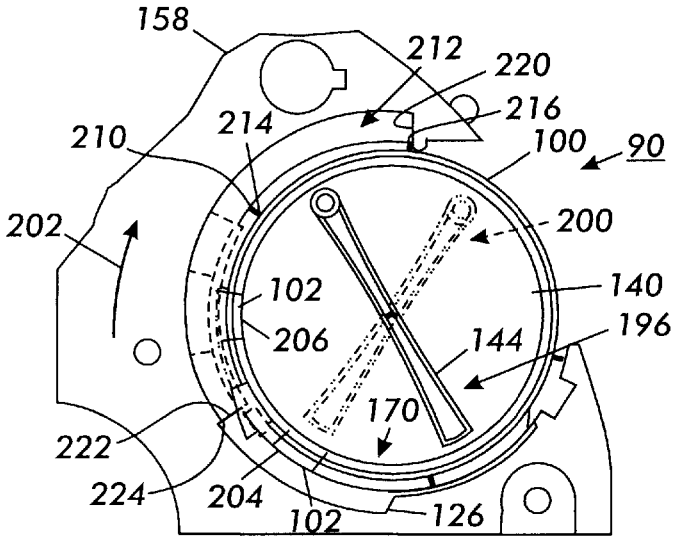
FIG. 7 is an end view of the FIG. 1 toner container showing the container and the adapter of FIG. 6 in the load position in solid and in the installed position in phantom.

Referring now to FIG. 7, the container 90 is shown installed into the adapter 158. Loading position 196 is shown in solid. The container 90 is rotated from loading position 196 to installed position 200 (shown in phantom) by rotating the handle 144 on the plug 140 of the container 90 in the direction of arrow 202. In the load position 196, aperture 102 through body 100 of the container 90 is covered by the cover 126.

Preferably, and as shown in FIG. 7, the container 90 includes a rotation limiting protrusion 210. The protrusion 210 is preferably integral with the body 100 and is fitted into a rotation protrusion pocket 212 formed in the adapter 158. As the container 90 is rotated in the direction of arrow 202, the protrusion 210 moves from a protrusion load position 214 to a protrusion installed position 216. In the protrusion installed position 216, the rotation limiting protrusion 210 is in contact with the rotation protrusion pocket stop 220 formed in the rotation protrusion pocket 212 thereby limiting the rotation of the container 90 in the direction of arrow 202.

As the container 90 is rotated in the direction of arrow 202, the cover 126 is restrained by the adapter cover pocket 170 with cover side face 222 being restrained by cover pocket side face 224. Face 224 serves as stop 146 of the developer unit (see FIG. 1).

As the body 100 of the container 90 continues to rotate in the direction of arrow 202, the aperture 102 in the body 100 of the container 90 moves from load position 204 of aperture 102 to fill position 206 of aperture 102. Since the cover 126 is not permitted to rotate and the body 100 is permitted to rotate, the aperture 102 is thereby separated from the cover 126 thereby permitting marking particles to pass through aperture 102 of the container 90.

Referring again to FIG. 6, preferably, the adapter 158 further includes an adapter opening 226 which is in alignment with the aperture 102 of the body 100 of the container 90 when the container 90 is in the installed position 200. The adapter opening 226 permits marking particles to travel from the aperture 102 into the adapter opening 226.

Communication of the marking particles from the aperture 102 of the container 90 to the appropriate one of the adapter units 42, 44, 46 and 48 of the development station 40 may be accomplished in any suitable fashion. For example, as shown in FIG. 6, the adapter 158 includes an adapter tube 230 formed in the adapter 158. The adapter tube 230 is in communication with one of the developer units 42, 44, 46 or 48.

As shown in FIG. 6, the adapter 158 may further include an adapter tube opening 232 which communicates between the adapter tube 230 and the adapter opening 226. Therefore, the marking particles pass from the adapter opening 226, to the adapter tube opening 232, to the adapter tube 230, and thereby to the respective developer unit 42, 44, 46, or 48.

Referring again to FIG. 9, the latching member 160 is shown in greater detail. The latching member 160 as shown in FIG. 9 is shown in relaxed position 186 with free end 182 of the latching member 160 in contact with the body locking feature 192 of the body 100 of the container 90.

The body locking feature 192 as shown in FIG. 9, is in the form of a protrusion extending outwardly from the body 100 and integral therewith. The body locking feature cooperates with the free end 182 of member 160 to prevent motion of the cover 126 in the direction of arrow 234. Also, it should be appreciated that the protrusion 192 cooperates with surface 236 of the cover 126 to prevent motion of the cover 126 in the direction of arrow 240.

The latching member 160 may be made of any suitable, durable material and, for example may be made of a plastic. Preferably, the latching member 160 is made of a resilient material such that the latching member 160 may be repeatedly movable from relaxed position 186 to restrained position 190 (see FIG. 8).

Preferably, as shown in FIG. 9, the latching member 160 is integral with the cover 126 and extends outwardly therefrom. The cover 126 as such is preferably made of a suitable, resilient plastic, for example polypropylene. The latching member 160 may include a fixed end 242 extending from the cover 126 and free end 182 opposed to and distal with respect to fixed end 242. The free end 182 of the latching member 160 includes contact face 180 for contacting the adapter 158 (see FIG. 8).

Figure 10:
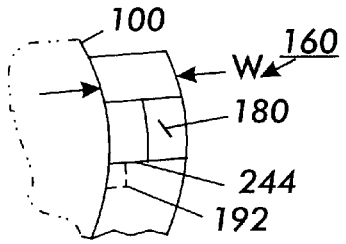
FIG. 10 is a partial left side view of the door of FIG. 9 showing the latching member in greater detail and showing the FIG. 1 container in phantom.
Figure 11:
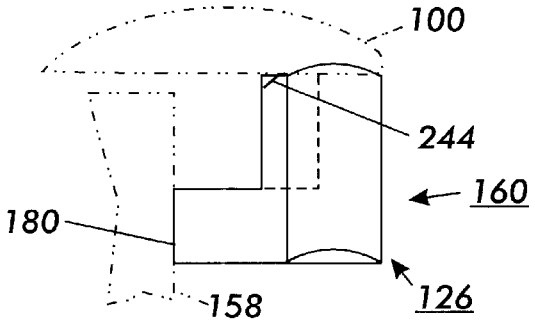
FIG. 11 is a partial top view of door of FIG. 9 showing the latching member in greater detail, showing the door in engagement with the FIG. 6 adapter and showing the FIG. 1 container and the FIG. 6 adapter in phantom.

Referring now to FIGS. 9, 10, and 11, the free end 182 of the latching member 160 includes a latching face 244 for contact with the protrusion 192. The latching face 244 of the latching member 160 is engaged with the protrusion 192 when the latching member 160 is in the relaxed position 186. Conversely, the latching face 244 is separated from the protrusion 192 when the latching member 160 is in the restrained position 190 (see FIG. 8).

As shown in FIGS. 9–11, the latching member 160 may have any suitable dimensions compatible with the material for which the cover 126 is molded. For example, if the cover 126 is molded from polypropylene, the latching member 160 may have a length (LL) of, for example, 0.5 inches and a width (W) of, for example, 0.15 inches as well as a thickness (LMT) of, for example, 0.06 inches.

Referring again to FIG. 9, in order that the cover 126 may remain generally positioned in alignment with the aperture 102 of the body 100, preferably, the body 100 includes rails 250 molded integrally with the body 100. The rails 250 preferably cooperate with guides 252 located on opposed ends of the cover 126.

Preferably, to interlock the cover 126 to the body 100, the rails 250 of the body 150 each include a lip 254 molded integrally with the rail 250. Similarly, the guides 252 each include a lip 256 formed in the guide 252 of the cover 126. The lips 256 in the cover 126 interconnect with the lips 254 in the rail 250 of the body 100, thereby interlocking the body 100 to the cover 126.

Figure 14:
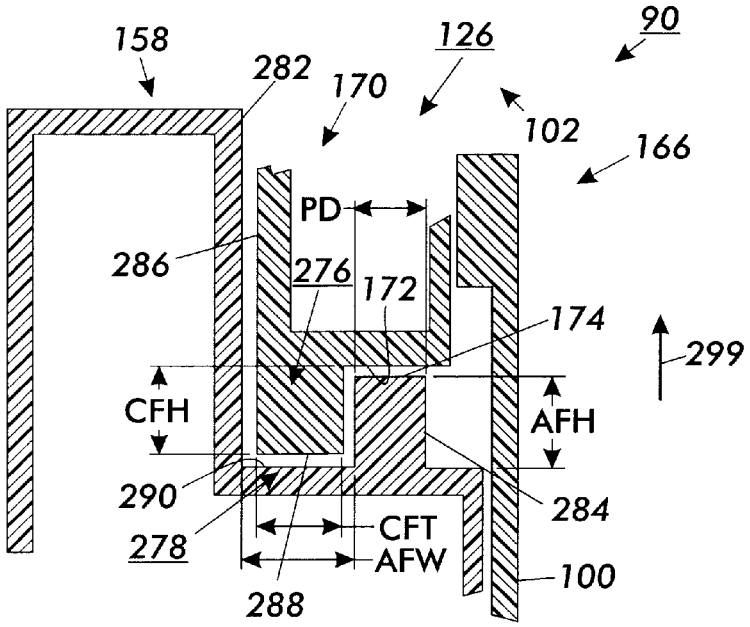
FIG. 14 is a cross sectional view of the container and adapter of FIG. 12 along the line 14—14 in the direction of the arrows.

According to the present invention, and referring now to FIG. 14, a cover securing feature 276 is shown as part of the container 90. The container 90 is fittable into the adapter 158. The adapter 158 has an adapter securing feature 278, which is associated with the adapter 158. The container 90 includes the body 100 which defines a chamber therein for storing particles. The body 100 defines the aperture 102 (see FIG. 1). The container 90 further includes the cover 126, which is utilized to cover the aperture 102. The container 90 further includes the cover securing feature 276. The cover securing feature 276 is associated with the cover 126. The cover securing feature 276 cooperates with the adapter securing feature 278 on the adapter 158 for radially securing the cover 126 with respect to the adapter 158.

While the cover securing feature 276 may have any shape and configuration which may cooperate with the adapter securing feature to radially secure the cover 126, preferably, the cover securing feature 276, for simplicity and to minimize costs, is integral with the cover 126. While it should be appreciated that the adapter securing feature 278 may be a raised or extended feature from the adapter 158 and the cover securing feature 276 be a void or groove within the cover 126, preferably the cover securing feature 276 as shown in FIG. 14, is in the form of a protrusion extending outwardly from cover seating face 172. Preferably, as shown in FIG. 14, the adapter securing feature 278 is matingly fitted with the cover securing feature 276 and, as shown in FIG. 14, is in the form of a groove formed in the adapter 158.

Figure 13:
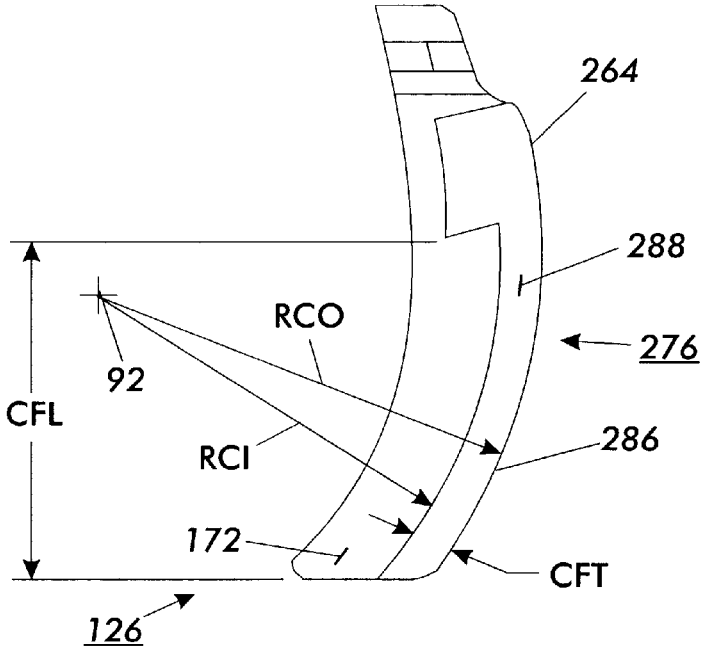
FIG. 13 is a left side view of the door of FIG. 9 showing the door securing feature of the present invention in greater detail.

Referring now to FIG. 13, the cover securing feature 276 is shown in greater detail. As shown in FIG. 13, the cover securing feature 276 extends outwardly from cover seating face 172 of the cover 126.

While the cover securing feature 276 may have any suitable shape, for simplicity and to provide for a sturdy securing feature, the cover securing feature 276 preferably has an arcuate shape. The cover securing feature 276 is in the form of an arcuate rail or protrusion that extends outwardly from cover seating face 172.

The cover securing feature is defined by an inner radius RCI and an outer radius RCO extending from axis 92. The cover securing feature 276 has a length CFL of, for example, of 15 millimeters. The difference CFT between the inner and outer radius RCO and RCI is approximately, for example, 1.5 millimeters. The cover securing feature 276 extends from first cover protrusion 264 to the opposed end of the cover 126.

Referring again to FIG. 14, the cover securing feature 276 of the cover 126 is shown installed into the adapter securing feature 278 of the adapter 158. The cover securing feature 276 has a height CFH extending downwardly from cover seating face 172 of the cover 126 a distance of, for example, 3 millimeters.

In order that the cover 126 may be easily installed and removed from the adapter 158 preferably, the cover securing feature 276 is slidably positioned into the adapter securing feature 278. Thus, the adapter securing feature 278 has an adapter feature width AFW of, for example, 1.6 millimeters, and is slightly larger than the thickness CFT of the cover 126.

The adapter securing feature 278 is shown in FIG. 14 in the form of a pocket extending from adapter face 282 to second pin 284 of the adapter 158. The face 282 of the adapter 158 preferably has an arcuate surface which closely conforms to outer surface 286 of the cover 126 formed by radius RCO.

The second pin 284 preferably has a cylindrical shape including a diameter PD of for example, 2 millimeters. The second pin 284 has a height AFH of for example, 3 millimeters. When in the installed position, the pocket seating face 174 of the second pin 284 seats or mates against the cover seating face 172 of the cover 126. Simultaneously, as shown in FIG. 14, outer face 288 of the cover securing feature 276 simultaneously seats with adapter feature face 290 formed in the adapter 158 between face 282 and the second pin 284.

Figure 12:
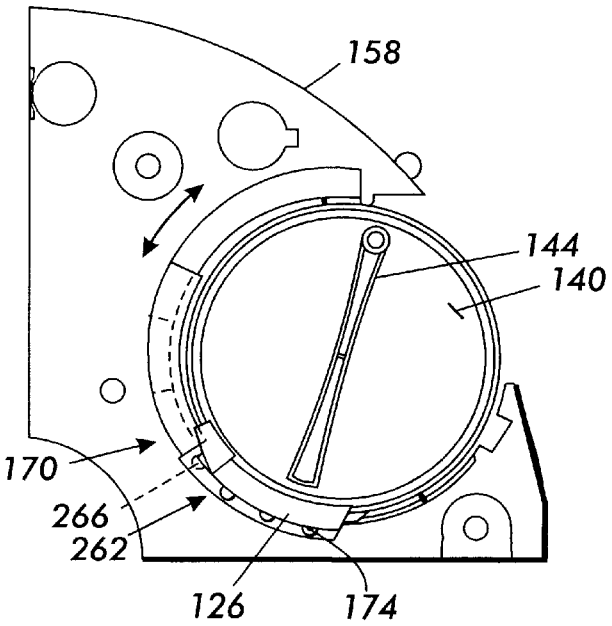
FIG. 12 is an end view of the FIG. 1 toner container and the FIG. 6 adapter showing the container in the installed position in the adapter.

Referring to FIG. 12, the container 90 is shown in solid installed properly into the container pocket 166 of the adapter 158. In the absence of the cover securing feature 276, if the container 90 is rotated by the handle 144 in the direction of arrow 292, while simultaneously pushing the handle 144 in the direction of arrow 294, the cover 126 may separate from pocket 170 and the adapter 158 may deflect and pocket 166 may expand in the direction of arrows 296 permitting the container 90 with the pocket 126 to become mispositioned as shown in phantom as reference numeral 298.

In the position as shown in phantom 298, toner may spill excessively around the developer, causing a catastrophic contamination of toner within the developer unit. When used in a multi-color printing machine, the toner of different colors in the developer unit will mix together rendering them unusable. A service call will be required to clean the machine and an extensive interruption in the use of the printing machine will occur. However, referring to FIG. 14, with the use of the cover securing feature 276 and the adapter securing feature 278, if the container 90 is urged radially in the direction of arrow 299, the pin 284 in the adapter 158 catches the cover securing feature 276 preventing the cover 126 from escaping the cover pocket 170. Thus the cover securing feature 276 and the adapter securing feature 278 cooperate to prevent the separation of the container 90 form the adapter 158 and the resultant spilling of toner.

Referring now to FIGS. 9 and 12, the container 90 further includes a cover feature 260 associated with the cover 126. The cover feature 260 cooperates with an adapter feature 262 on the adapter 158 for permitting the container to be fully installed into only the properly corresponding adapter. For example, the container 90 may be utilized for only a first color, for example, cyan. The container 90 should be inserted only into one of the developer units 42, 44, 46 or 48 (see FIGS. 4 and 5), namely the cyan developer. However, a second container (not shown) which is utilized in any of the other three of the four developer units 42, 44, 46 or 48, namely the yellow, magenta or black developers, should not be insertable into the cyan developer. The second container is similar to the first container 90 but does not include at least one of the cover feature 260 and the adapter feature 262 so that the second container may not be fully installed into the adapter 158.

For example, referring to FIGS. 9 and 12, the adapter feature 262 may be in the form of a series of cylindrical protrusions extending outwardly from the adapter cover pocket 170 and the cover feature 260 may be in the form of protrusions extending outwardly from seating face 172 of cover 126. For example, as shown in FIGS. 9 and 11, the cover 126 may include first protrusion 264 which would be alignment with first pin 266 in the adapter 158 of FIG. 12.

If, however, the first pin 266 is broken or removed from the adapter 158, the first protrusion 264 is permitted to extend downwardly into where the first pin 266 would otherwise be located and seating face 172 may progress downwardly toward adapter seating face 174 located on the outer end face of adapter feature 262.

It should be appreciated that only a container 90 with a cover feature 260 including protrusion 264 (in other words, not a cover 126 including any of protrusions 270, 272, or 274 (as shown in Phantom) would permit the surface 174 of the adapter 158 to seat against seating face 172 of the cover 126. Thus, only protrusion 264 and missing pin 266 permit the container 90 to fully install in the adapter 158.

It should be appreciated that by utilizing the latching member 160 which has a contact face 180 which cooperates with surface 184 of the adapter 158, the latching member 160 prevents the rotation of the container 90 in the direction of arrow 202 (see FIG. 7) until the container 90 is fully seated in the direction of axis 92. Unless the adapter feature 262 of the adapter 158 corresponds with the cover feature 260 of the cover 126 of FIG. 9, the container 90 is not fully installed. The container of a particular color and the adapter 158 of a particular color are required to correspond to each other in order that they mate to each other and unlatch the latching feature 160. Therefore, each container 90 must correspond with the desired color for the adapter 158 in order for the container 90 to be opened within the adapter 158 thereby preventing the loading of an improper color into a developer unit.

By providing a toner container including a cover securing feature which mates to an adapter securing feature on the developer unit, the rails of the toner cartridge may be accurately and positively aligned to the rails of the developer unit, avoiding misloading of the toner container and resultant spills of toner material.

By providing a toner container with a cover securing feature in the form of a protrusion which mates with a pocket or groove in the developer unit, the cartridge is assured to not bias away from the machine, and therefore the toner container will remain sealed against the adapter of the machine, eliminating toner linkage and resultant machine interruption and expensive service calls for the machine.

By providing a cover securing feature in the form of a protrusion extending from a toner container cover, minimal to no part cost increase is associated with providing this cover securing feature which eliminates leakage of toner from the machine.

By providing a cover securing feature which is integral with, and molded with, the slidable cover of a toner cartridge, a cover securing feature may be provided which requires no additional assembly of the cover onto the container.

By providing a cover securing feature which is integral with the cover slidable on the container, the slidable cover with the securing feature may be installed into a developer unit with no additional effort on the part of the customer during installation.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A container for storing a supply of particles for use in a developer unit of an electrophotographic printing machine, the developer unit including an adapter having an adapter feature, the container being fittable to the adapter, the container comprising:

a body defining a chamber for storing particles therein, said body defining an aperture in the periphery thereof;

a cover for use in covering the aperture, said cover being slidably fitted to said body along an outer periphery of said body, said cover being selectively slidably positionable with respect to said body from a first position in which said cover substantially blocks the aperture to a second position in which said cover does not substantially block the aperture; and a securing feature associated with said cover, said securing feature cooperating with the adapter feature on the adapter for radially securing the cover with respect to the adapter.

2. A container for storing a supply of particles for use in a developer unit of an electrophotographic printing machine, the developer unit including an adapter having an adapter feature, the container being fittable to the adapter, the container comprising:

a body defining a chamber for storing particles therein, said body defining an aperture in the periphery thereof;

a cover for use in covering the aperture; and a securing feature connected to said cover, said securing feature cooperating with the adapter feature on the adapter for radially securing the cover with respect to the adapter, wherein said cover includes a latching member having a pliable arm extending from said cover;

wherein said body includes a protrusion extending from said body, said arm cooperating with said protrusion to latch said cover in a first position in which said cover substantially blocks the aperture;

wherein said pliable arm cooperates with a surface on the adapter as the container is fitted into the adapter to move the pliable arm from the latched position to the unlatched position as the container is fitted into the adapter; and wherein said securing feature is engaged with the adapter feature when the pliable arm is in the unlatched position.

3. A container for storing a supply of particles for use in a developer unit of an electrophotographic printing machine, the developer unit including an adapter having an adapter feature, the container being fittable to the adapter, the container comprising:

a body defining a chamber for storing particles therein, said body defining an aperture in the periphery thereof;

a cover for use in covering the aperture;

a securing feature connected to said cover, said securing feature cooperating with the adapter feature on the adapter for radially securing the cover with respect to the adapter; and a latching member having a latched position wherein said cover is fixedly positioned with respect to said body and having an unlatched position wherein said cover is moveable with respect to said body, said latching member being moved from the latched position to the unlatched position as the container is fitted into the adapter, wherein said securing feature is engaged with the adapter feature when said latching member is in the unlatched position.

4. A developer unit for developing a latent image recorded on an image receiving member of an electrophotographic printing machine, the developer unit comprising:

an adapter having an adapter feature; and a container for storing a supply of particles including a body defining a chamber for storing particles therein, said body defining an aperture in the periphery thereof; a cover for use in covering the aperture; and a securing feature connected to said cover, said securing feature cooperating with the adapter feature on the adapter for radially securing the cover with respect to the adapter, said cover being slidably fitted to said body along an outer periphery of said body, said cover being selectively slidably positionable from a first position in which said cover substantially blocks the aperture to a second position in which said cover does not substantially block the aperture.

5. A developer unit for developing a latent image recorded on an image receiving member of an electrophotographic printing machine, the developer unit comprising:

an adapter having an adapter feature; and a container for storing a supply of particles including a body defining a chamber for storing particles therein, said body defining an aperture in the periphery thereof, a cover for use in covering the aperture, and a securing feature connected to said cover, said securing feature cooperating with the adapter feature on said adapter for radially securing said cover with respect to said adapter, wherein said cover includes a latching member having a pliable arm extending from said cover, wherein said body includes a protrusion extending from said body, said arm cooperating with said protrusion to latch said cover in a first position in which said cover substantially blocks the aperture, wherein said pliable arm cooperates with a surface on the adapter as the container is fitted into the adapter to move the pliable arm from the latched position to the unlatched position as the container is fitted into the adapter, and wherein said securing feature is engaged with the adapter feature when the pliable arm is in the unlatched position.

6. A developer unit for developing a latent image recorded on an image receiving member of an electrophotographic printing machine, the developer unit comprising:

an adapter having an adapter feature;

a container for storing a supply of particles including a body defining a chamber for storing particles therein, said body defining an aperture in the periphery thereof, a cover for use in covering the aperture, and a securing feature connected to said cover, said securing feature cooperating with the adapter feature on said adapter for radially securing said cover with respect to said adapter; and a latching member having a latched position wherein said cover is fixedly positioned with respect to said body and having an unlatched position wherein said cover is moveable with respect to said body, said latching member being moved from the latched position to the unlatched position as the container is fitted into the adapter, wherein said securing feature is engaged with the adapter feature when said latching member is in the unlatched position.

7. An electrophotographic printing machine for developing a latent image recorded on an image receiving member with a supply of particles, the printing machine comprising:

a developer unit including an adapter having an adapter feature; and a container for storing a supply of particles, said container fitted at least partially into said adapter, said container including a body defining a chamber for storing particles therein, said body defining an aperture in the periphery thereof, a cover for use in covering the first aperture, and a securing feature connected to said cover, said securing feature cooperating with the adapter feature on said adapter for radially securing said cover with respect to said adapter, wherein said cover is slidably fitted to said body along an outer periphery of said body, said cover being selectively slidably positionable from a first position in which said cover substantially blocks the aperture to a second position in which said cover does not substantially block the aperture.

8. An electrophotographic printing machine for developing a latent image recorded on an image receiving member with a supply of particles, the printing machine comprising:

a developer unit including an adapter having an adapter feature; and a container for storing a supply of particles, said container fitted at least partially into said adapter, said container including a body defining a chamber for storing particles therein, said body defining an aperture in the periphery thereof, a cover for use in covering the first aperture, and a securing feature connected to said cover, said securing feature cooperating with the adapter feature on said adapter for radially securing said cover with respect to said adapter, wherein said cover includes a latching member having a pliable arm extending from said cover, wherein said body includes a protrusion extending from said body, said arm cooperating with said protrusion to latch said cover in a first position in which said cover substantially blocks the aperture, wherein said pliable arm cooperates with a surface on the adapter as the container is fitted into the adapter to move the pliable arm from the latched position to the unlatched position as the container is fitted into the adapter and wherein said securing feature is engaged with the adapter feature when the pliable arm is in the unlatched position.

9. An electrophotographic printing machine for developing a latent image recorded on an image receiving member with a supply of particles, the printing machine comprising:

a developer unit including an adapter having an adapter feature; and a container for storing a supply of particles, said container fitted at least partially into said adapter, said container including a body defining a chamber for storing particles therein, said body defining an aperture in the periphery thereof, a cover for use in covering the first aperture, a securing feature connected to said cover, said securing feature cooperating with the adapter feature on said adapter for radially securing said cover with respect to said adapter, and a latching member having a latched position wherein said cover is fixedly positioned with respect to said body and having an unlatched position wherein said cover is moveable with respect to said body, said latching member being moved from the latched position to the unlatched position as the container is fitted into the adapter, wherein said securing feature is engaged with the adapter feature when said latching member is in the unlatched position.

* * * * *